US005853120A

United States Patent [19]

McLeod et al.

[11] Patent Number: 5,853,120

[45] Date of Patent: Dec. 29, 1998

[54] TRAY APPARATUS WITH REINFORCED CORNER STRUCTURE

[75] Inventors: Michael B. McLeod, Romeoville; Russell A. Leavitt, Woodridge; Elizabeth G. Wilson, Wheaton, all of Ill.

[73] Assignee: Stone Container Corporation, Chicago, Ill.

[21] Appl. No.: 690,074

[22] Filed: Jul. 31, 1996

[51] Int. Cl.[6] ..... B65D 5/4805

[52] U.S. Cl. ..... 229/120.09; 206/736; 229/143; 229/147; 229/169; 229/190; 229/918

[58] Field of Search ..... 229/174, 172, 229/169, 190, 918, 142, 143, 147, 154, 120.09, 919; 206/192, 731, 736

[56] References Cited

U.S. PATENT DOCUMENTS

| | | | |
|---|---|---|---|
| 2,706,076 | 4/1955 | Guyer | 229/51 |
| 3,002,613 | 10/1961 | Merkel et al. | 229/120.09 X |
| 3,209,941 | 10/1965 | Krake | 229/120.09 X |
| 3,468,469 | 9/1969 | Kossoff et al. | 229/143 |
| 3,545,666 | 12/1970 | Visvydas | 229/918 X |
| 3,871,570 | 3/1975 | Garmon | 229/31 R |
| 4,349,147 | 9/1982 | Jensen | 229/34 |
| 4,488,641 | 12/1984 | Nishiguchi et al. | 206/736 X |
| 4,531,668 | 7/1985 | Forbes, Jr. | 229/43 |
| 4,537,344 | 8/1985 | Thomas | 229/143 X |
| 4,860,948 | 8/1989 | Hofstede | 229/918 X |
| 4,883,221 | 11/1989 | Brundage | 229/143 |
| 4,887,766 | 12/1989 | Schoeneweis | 229/143 X |
| 5,078,273 | 1/1992 | Kuchenbecker | 229/207 |
| 5,163,609 | 11/1992 | Muise, Jr. | 229/174 X |

FOREIGN PATENT DOCUMENTS

| | | | |
|---|---|---|---|
| 2329522 | 5/1977 | France | 229/143 |
| 2669893 | 6/1992 | France | 229/120.09 |

OTHER PUBLICATIONS

SWF Machinery International Design Bulletin No. 145, Dated Mar., 1984.

SWF Machinery Design Bulletin No. 154, Dated Aug./Sep. 1984.

*Primary Examiner*—Stephen P. Garbe

*Attorney, Agent, or Firm*—Dick and Harris

[57] ABSTRACT

A container tray apparatus of the wraparound type is provided with reinforcing corner support members. The tray apparatus features internal minor flaps which have been split to create inner and outer flaps which can be folded and aligned on the inside and the outside of the corner areas of the tray apparatus to provide vertically extending corner support structures in addition to the corners formed by the end and side walls of the container tray apparatus, to provide enhanced stacking strength without requiring additional container material in the blank.

2 Claims, 3 Drawing Sheets

Fig 9A
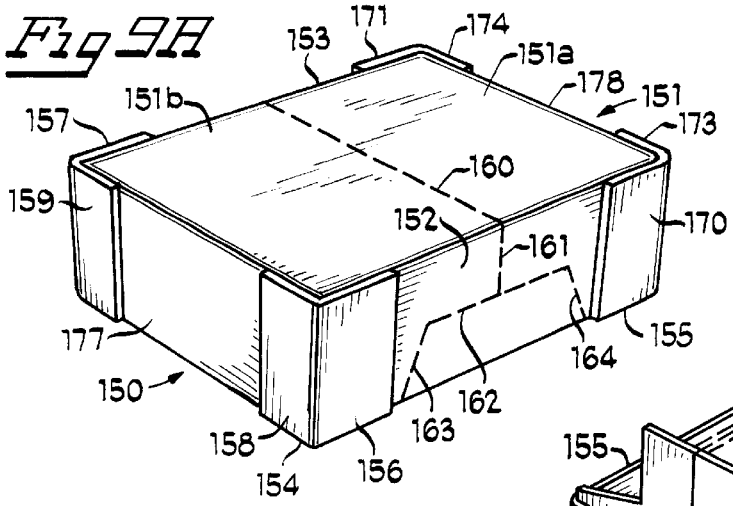
Fig 9B
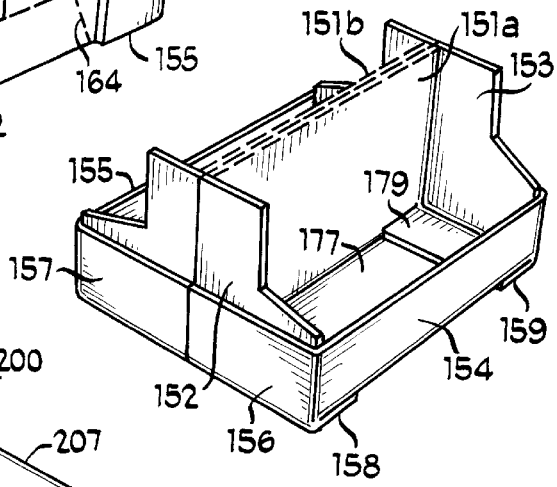
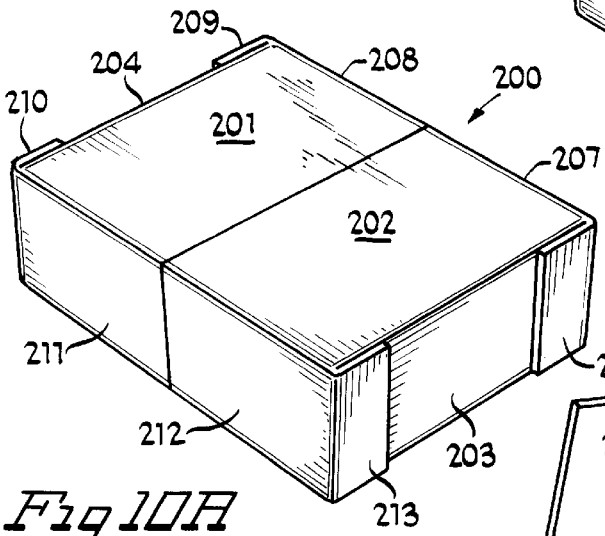
Fig 10A
Fig 10B
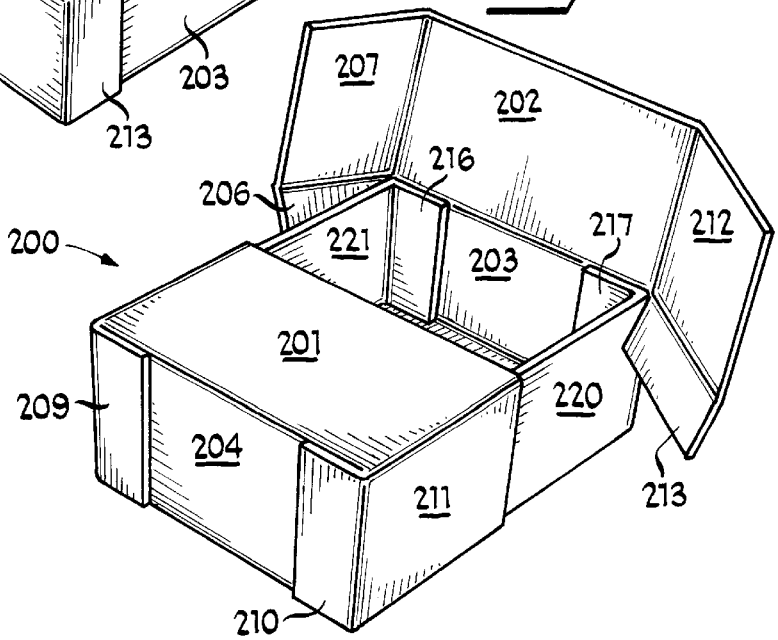

TRAY APPARATUS WITH REINFORCED CORNER STRUCTURE

BACKGROUND OF THE INVENTION

The present invention is directed to container tray apparatus, of the wraparound type. In particular, the present invention is directed to container tray apparatus of the kind which are formed from one or more blanks of container material, such as corrugated paperboard.

In the construction of container tray apparatus, such as are known in the prior art, there is typically a tradeoff between attempting to obtain a maximum amount of strength, such as stacking or crush resistance strength, and attempting to reduce the amount of container material in the blank or blanks from which the container tray apparatus is formed. While it is desirable to provide as much strength as possible, such strength typically comes at the expense of having to provide additional container material in the blank which increases the cost of the container tray apparatus. In addition, sometimes container tray apparatuses are provided with reinforcing structures which not only may require the addition of material to the blank, but also may sometimes result in container blanks having unusual, typically highly non-rectangular configurations, which can likewise add to the overall cost of the container tray apparatus, and which can increase the difficulty in the fabrication and erecting of the container tray apparatus.

Accordingly, it would be desirable to provide a container tray apparatus of the kind which is formed from one or more blanks of container material, which has a simplified blank form for enhanced manufacturability.

It would additionally be desirable to provide a container tray apparatus which is provided with further corner reinforcing structures, from one blank, which structures are articulable into vertical stacking support positions about the basic container flaps, and with minimized blank material—for enhanced stacking strength.

These and other objects of the invention will become apparent in light of the present specification including claims, and drawings.

SUMMARY OF THE INVENTION

The present invention is directed to a container tray apparatus for the facilitated containment of articles, of the kind having at least one bottom wall member having at least a first side edge region and at least a first end edge region, at least a first side wall member operably connected to the at least first side edge region of the at least one bottom wall member, and at least a first end wall member operably connected to the at least first end edge region of the at least one bottom wall member, the at least first side wall member and the at least first end wall member being operably arrangeable with respect to one another so as to define at least a first corner region of the container tray apparatus, the at least first side wall member and the at least first end wall member further being operably arrangeable relative to the at least one bottom wall member, upon articulation, so as to further at least partially define an article containment region.

The improvement in the container tray apparatus comprises at least one top wall member, operably positionable, upon said articulation, in substantially spaced, parallel, overlying relation to at least a portion of the at least one bottom wall member, the at least one top wall member, when positioned in said substantially spaced, parallel, overlying relation to the at least a portion of the at least one bottom wall member, being substantially maintained in said overlying position over the at least first corner region by the at least first side wall member and the at least first end wall member; and corner support means, operably emanating from and articulable to at least the at least first top wall member, for providing vertical loading support for the container tray apparatus, toward providing resistance to undesired collapsing of said at least first corner region of the container tray apparatus upon the stacking of articles on top of the container tray apparatus.

The corner support means further comprise at least one corner support member which, upon articulation, is operably positionable in substantially parallel, partially overlying relation to the outer surface of at least one of the at least first side wall member and the at least first end wall member, and affixable thereto, for providing support for the at least first corner region.

Preferably, the container tray apparatus further comprises at least a second side edge region disposed on the at least one bottom wall member substantially opposite to the at least first side edge region; at least a second end edge region disposed on the at least one bottom wall member substantially opposite to the at least first end edge region; at least a second side wall member operably connected to the at least second side edge region of the at least one bottom wall member; at least a second end wall member operably connected to the at least second end edge region of the at least one bottom wall member, the at least first and second side wall members and the at least first and second end wall members being operably arrangeable, upon articulation, with respect to one another so as to define, further at least second, third and fourth corner regions of the container tray apparatus. The at least first and second side wall members and the at least first and second end wall members further are operably arrangeable, upon articulation, relative to the at least one bottom wall member, so as to further define further portions of the article containment region.

At least a second top wall member is operably positionable, upon said articulation, in substantially spaced, parallel, overlying relation to at least a portion of the at least one bottom wall member, the at least second top wall member, when positioned in said substantially spaced, parallel, overlying relation to the at least a further portion of the at least one bottom wall member.

The corner support means further include one or more further corner support members which, upon articulation, are operably positionable, in substantially parallel, partially overlying relation to the outer surface of at least one of the at least first and second side wall members and at least one of the at least first and second end wall members, and affixable thereto, so as to provide at least one corner support member in each of the further second, third and fourth corner regions of the container tray apparatus.

The at least one corner support member for the at least first corner region further comprises a first corner support member which, upon articulation, is operably positionable in substantially parallel, partially overlying relation to the at least first side wall member, and affixable thereto and a second corner support member which, upon articulation, is operably positionable in substantially parallel, partially overlying relation to the at least first end wall member, and affixable thereto. In a preferred embodiment of the invention, a third corner support member which, upon articulation, is operably positionable in substantially parallel, overlying relation to the at least first end wall member, and affixable thereto. The first corner support member preferably operably emanates from the at least one top wall member. The second corner support member preferably operably emanates from the first corner support member. The third corner support member operably emanates from the at least first side wall member.

The container tray apparatus further comprises, in an alternative embodiment, means for facilitating opening of the container tray apparatus to enable access to the article containment region. The means for facilitating opening of the container tray apparatus comprises at least one tearstrip member operably configured into the container tray apparatus, so as to enable the container tray apparatus to be opened, following articulation, loading and sealing of the container tray apparatus.

The means for facilitating opening of the container tray apparatus alternatively comprise at least a portion of the container tray apparatus, which is removable, so as to enable access into the article containment region, while maintaining the container tray apparatus in a substantially erected configuration so as to be capable of continued containment of articles within the article containment region.

The container tray apparatus further comprises means for enabling conversion of the container tray apparatus into a containment and display apparatus.

The means for enabling conversion of the container tray apparatus into a containment and display apparatus further a first plurality of perforations disposed in the at least first side wall member, for enabling removal of a portion thereof; and at least a second perforation extending across the at least one bottom wall member, operably configured so that upon removal of said portion of the at least first side wall, said container tray apparatus may be folded along said second perforation to form at least two article holding and displaying regions.

Preferably, the container tray apparatus is fabricated from a single monolithic sheet of container material, which, preferably, is corrugated paperboard.

BRIEF DESCRIPTION OF THE DRAWINGS

FIG. 9A is a perspective view of the container tray apparatus according to another alternative preferred embodiment, in which the tray can be broken open to form a display container tray apparatus;

FIG. 9B is a perspective view of the container tray apparatus according to the embodiment of FIG. 9A, which has been broken open;

FIG. 10A is a perspective view of the container tray apparatus according to still yet another alternative preferred embodiment of invention; and FIG. 10B is a perspective view of the container tray apparatus according to FIG. 10A, in which one of the top panels is open.

DETAILED DESCRIPTION OF THE INVENTION

While the present invention is susceptible of embodiment in many different forms, there are described herein in detail, several specific embodiments, with the understanding that the embodiments illustrated are to be considered as an exemplification of the principles of the invention, and are not intended to limit the invention to the embodiment illustrated.

Figure 1:
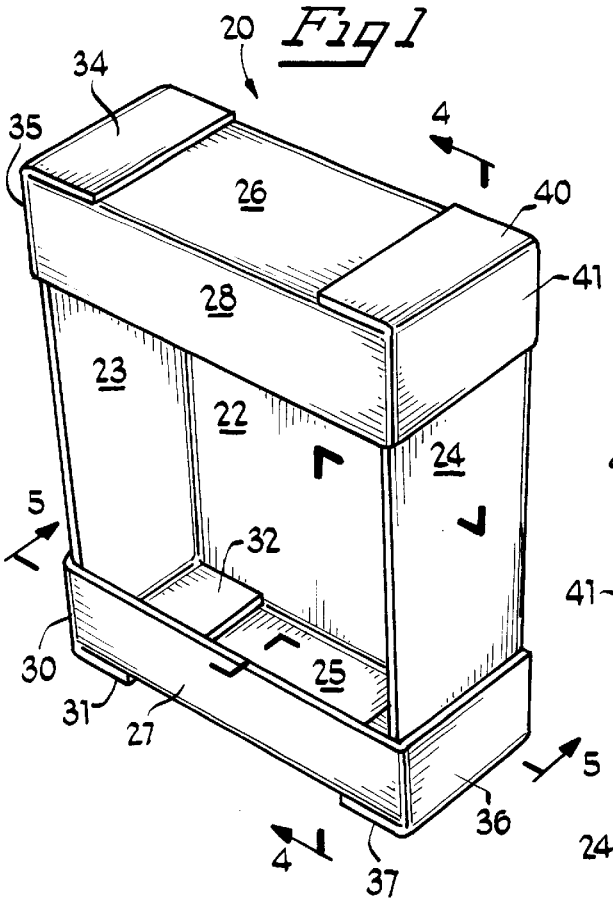
FIG. 1 is a perspective view of the container tray apparatus according to a preferred embodiment of the invention.
Figure 2:
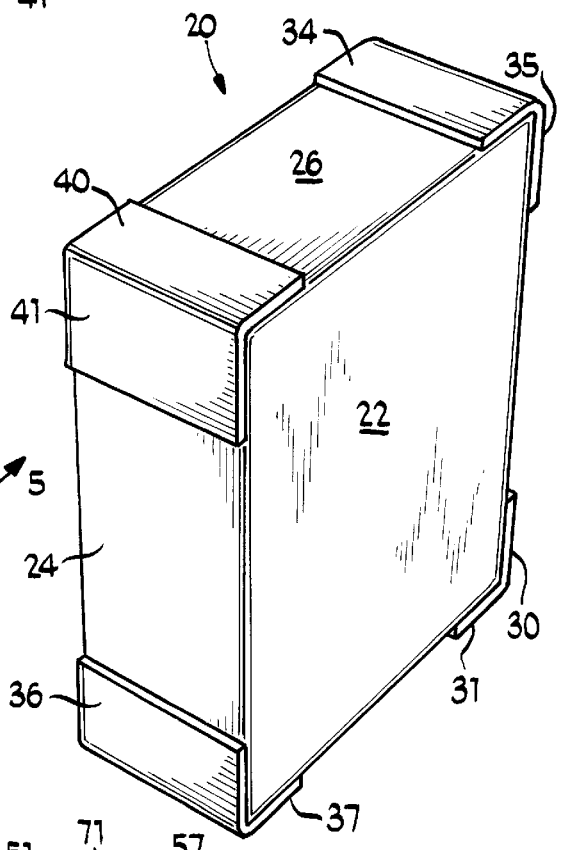
FIG. 2 is a perspective view of the container tray apparatus of FIG. 1, showing the bottom of the container tray.
Figure 3:
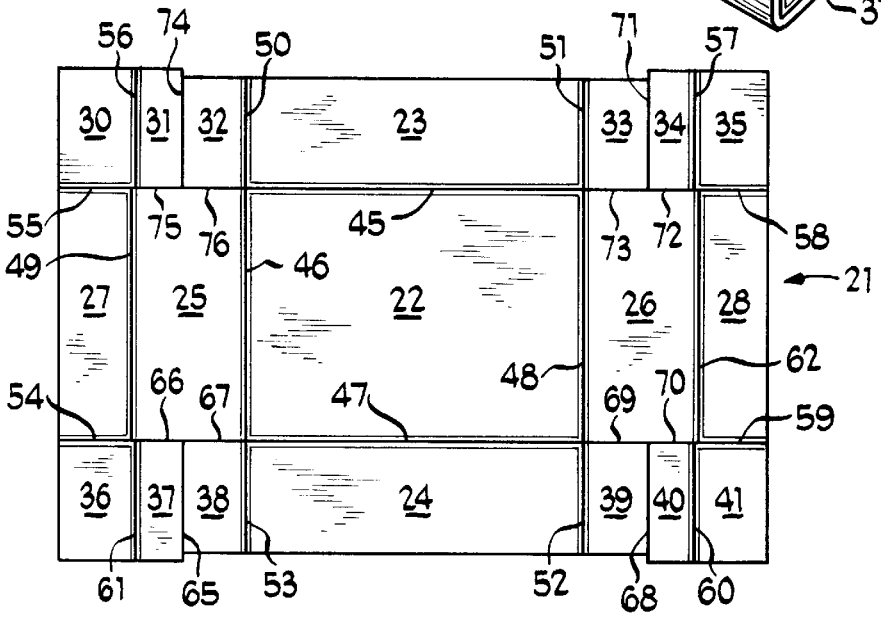
FIG. 3 is a top plan view of the blank used to form the container tray apparatus of FIGS. 1 and 2.
Figure 4:
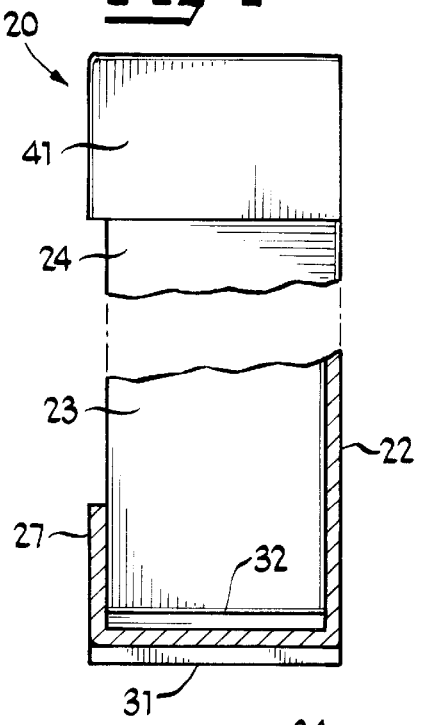
FIG. 4 is a side elevation, partially in section, taken along lines 4—4 of FIG. 1.
Figure 5:
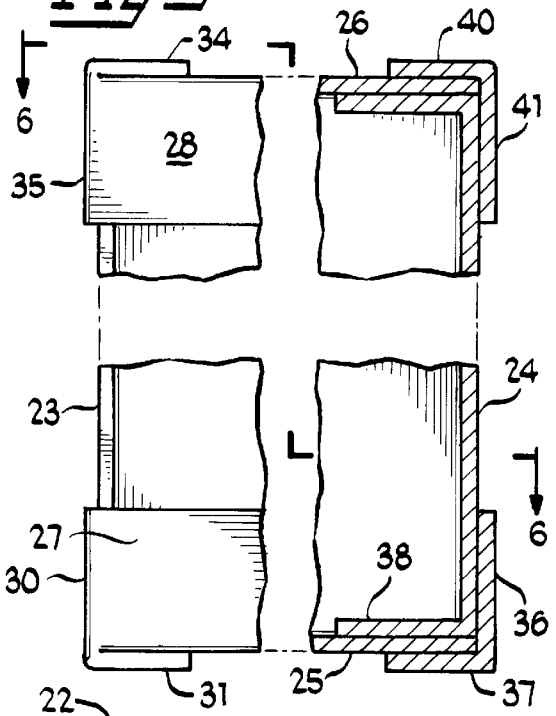
FIG. 5 is a side elevation, partially in section, of the container tray apparatus of FIG. 1, taken along lines 5—5.
Figure 6:
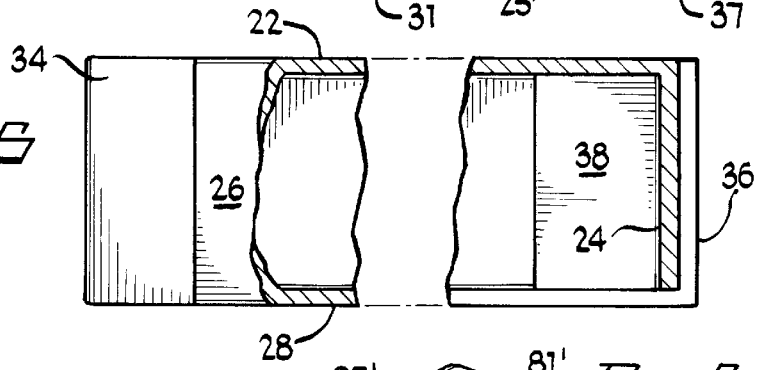
FIG. 6 is a side elevation, partially in section, taken along lines 6—6 of FIG. 5.

The container tray apparatus according to a preferred embodiment of the invention as illustrated in FIGS. 1–6. As can be seen in FIG. 3, the container tray apparatus is formed from a single blank of container material. Apparatus 20 is formed from a blank 21, which is fabricated from a suitable container material, such as cardboard, paperboard, or preferably corrugated paperboard. Blank 21 includes a bottom wall 22, side walls 23 and 24, end walls 25 and 26, partial top walls 27 and 28, and corner support members 30–41. Fold lines 45–62, and cuts 65–76 permit the articulation of blank 20 into the erected container tray apparatus 20 as illustrated in FIGS. 1, 2, 4–6. The preferred manner of raising blank 21 into container tray apparatus 20 is a follows. Firstly, corner support members 32 and 33 will be folded around fold lines 50 and 51 inwardly (toward the viewer as FIG. 3 is seeing) to positions substantially perpendicular to side wall 23. Similarly, corner support members 38 and 39 will be folded to positions substantially perpendicular to side wall 24. Side walls 23 and 24 will then be folded to positions substantially perpendicular to bottom wall 22. At this stage in the process, side walls 23 and 24 and corner support members 32, 33, 38 and 39 will all be substantially perpendicular to bottom wall 22. Further, corner support member 32 and 38 will extend substantially parallel to fold line 46, while corner support members 33 and 39 will extend substantially parallel to fold line 48.

Thereafter, end walls 25 and 26 will be folded to positions perpendicular to bottom wall 22, so that end wall 25 is adjacent and parallel to corner support members 32 and 38, while end wall 26 is adjacent and parallel to corner support members 33 and 39. A suitable adhesive material, such as a hot melt glue, or other suitable fastening means, such as staples, etc., can be used at this time to affix end wall 25 to corner support members 32 and 38, and to affix end wall 26 to corner support members 33 and 39. Once the end walls 25 and 26 have been raised perpendicular to bottom wall 22, partial top wall members 27 and 28 can be folded along respective fold lines 49 and 62, so as to become positioned perpendicular to their respective end walls 25 and 28, and substantially parallel to and in partially overlying relationship to bottom wall 22, resting atop the top edges of side walls 23 and 24, and corner support members 32 and 33 and 38 and 39.

Corner support members 30, 35, 36 and 41 are then folded downwardly about their respective fold lines 55, 58, 54 and 59, so that corner support member 30, 35, 36 and 41 assume positions substantially parallel and in overly outside relationship to respective end portions of side walls 23 and 24. Again, a suitable adhesive material or other fastening means can be applied during this step so as to affix corner support member 30, 35, 36 and 41 in place against side walls 23 and 24. The final step in the construction is then the folding of corner support members 31, 34, 37 and 40 about their respective fold lines 56, 57, 60 and 61, so that corner support members 31 and 34 are brought into positions parallel to and in overlying relationship with end wall 25, and corner support members 34 and 40 are brought into parallel overlying relationship to end wall 28. Corner support members 31, 34, 40 and 37 will then be affixed to their respective end walls utilizing the various means described hereinabove.

When fully erected, container tray apparatus 20 is provided with corner support structures having up to three parallel vertically extending layers of container material, and no fewer than two parallel vertically extending layers. It is believed that this improved container construction can have as much as two to three and one-half times the vertical stacking strength of comparably sized prior art container configurations.

FIGS. 7–10B illustrate three other alternative embodiments of the invention. While these alternative embodiments are provided with different features to enhance their use as, for example, display containers, the corner support construction is substantially identical to that already described with respect to the embodiment of FIGS. 1–6.

Figure 7:
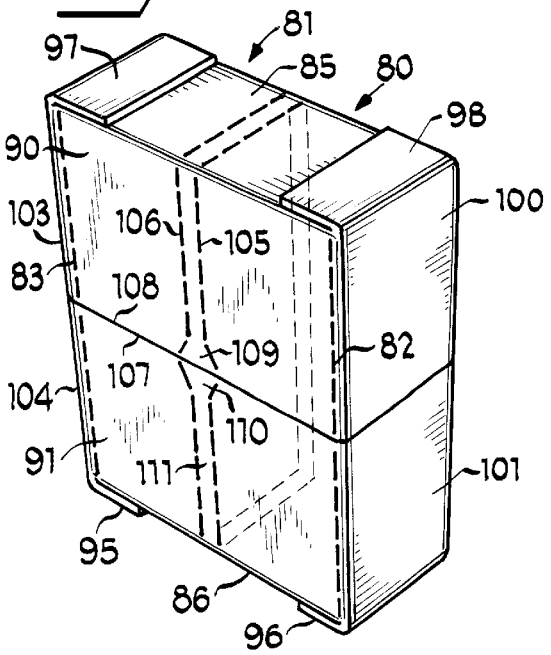
FIG. 7 is a perspective view of the container tray apparatus, according to alternative embodiment of the invention, including a complete top wall and bottom wall with an encircling perforated tearstrip structure.

FIG. 7, for example, illustrates container apparatus 80, having a bottom wall 81, side walls 82 and 83 (partially indicated by phantom lines), end walls 85 and 86, top wall members 90 and 91, and corner support members 95 through 98, and further corner support members 100 and 101. Top wall member 90 is provided with corner support member 100, from which corner support member 98 emanates. Corner support member 97 emanates from a corner support member (not shown) which emanates from the opposite edge of top wall member 90. Similarly, top wall member 91 is provided with corner support member 101, from which corner support member 96 emanates. Corner support member 95 emanates from a corner support member (not shown) which emanates from the opposite edge of top wall member 91. Top wall members 90 and 91 each comprise roughly half the area of bottom wall member 81, so that their edges meet at the position substantially midway along the length of apparatus 80. Corner support members 100 and 101 each comprise a member having a length substantially half the length of sidewall 82, and accordingly, sidewall 82 is completely covered by corner support members 100 and 101. Similarly, side wall 83 (which faces away from the viewer of FIG. 7) is covered by its respective adjacent overlying corner support members 103, 104. Inner corner support members (not shown) emanate from the ends of end wall members 85 and 86, in a manner similar to that described and shown with respect to the embodiment of FIGS. 1–6.

In order to facilitate the opening of a sealed container tray apparatus 80, a double line of perforations 105 and 106 may be provided, utilizing conventional scoring techniques, which extend around the circumference of the box, along its top, down its sides and across the back wall 81, so as to form tearstrip 111. Two tab members 109 and 110 are formed where the lines of perforation abut the facing edges 107 and 108 of top wall members 90 and 91, respectively. One or the other of tab members 109 and 110 can be depressed inwardly to permit the grasping and pulling of the other of tab members 109 and 110 to begin the tearing of the tearstrip 111 which is formed thereby. Once tearstrip 111 has been pulled completely around the circumference of apparatus 80, apparatus 80 will separate into two halves, thus permitting access to the goods contained therein.

Figure 8:
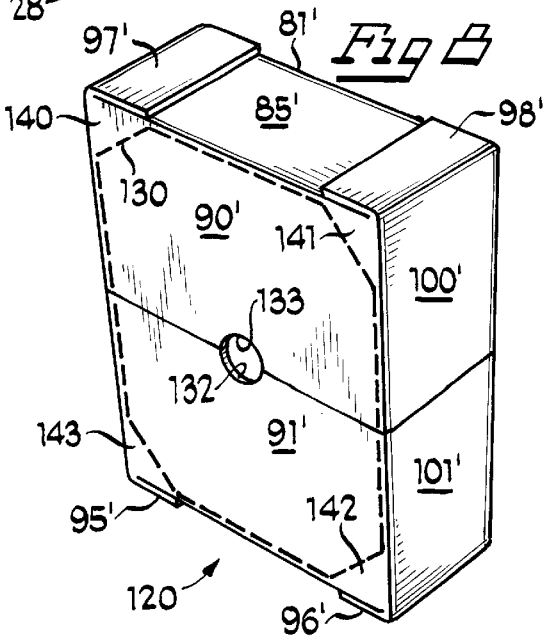
FIG. 8 is a perspective view of the container tray apparatus according to another alternative preferred embodiment of the invention.

The embodiment of FIG. 8 is a container apparatus 120 which has a substantially similar configuration to that of the embodiment of FIG. 7, in that top wall members 90' and 91' each have an area approximately one-half of the oppositely disposed bottom wall member 81'. Top wall member 90' is provided with corner support member 100', from which corner support member 98' emanates. Corner support member 97' emanates from a corner support member (not shown) which emanates from the opposite edge of top wall member 90'. Similarly, top wall member 91' is provided with corner support member 101', from which corner support member 96' emanates. Corner support member 95' emanates from a corner support member (not shown) which emanates from the opposite edge of top wall member 91'. Inner corner support members (not shown) emanate from the ends of end wall members 85' and 86', in a manner similar to that described and shown with respect to the embodiment of FIGS. 1–6.

Instead of using a row of parallel perforations so as to create a tearstrip, a line of perforations 130 is provided generally along the periphery of top wall members 90' and 91', cutting across diagonally in the corner regions thereof, as illustrated. One or more cutouts 132 and 133 may be provided to permit finger access into the interior of container tray apparatus 120, and underneath one or both of top wall members 90' and 91' to enable the outward tearing off of the portions of top wall members 90' and 91' which are surrounded by perforation line 130. Subsequent to the removal of the removable portions of top wall members 90' and 91', triangular portions 140–143 will remain, thus providing surfaces for enabling the continued stacking of container tray apparatus 120 atop one another, while still enabling access to the interior regions thereof.

FIGS. 9A and 9B illustrate still another alternative preferred embodiment of the invention. Apparatus 150 has a configuration which is substantially similar to that of apparatus 20 of FIGS. 1–6. Corner support members 156 and 157 emanate from opposite edges of top wall member 154 (which is on the underside of container tray apparatus 150 as illustrated in FIG. 9A). In turn, corner support members 158 and 159 emanate from corner support members 156 and 157, respectively. Corner support members 170 and 171 emanate from opposite edges of top wall member 155 (which is on the underside of container tray apparatus 150 as illustrated in FIG. 9A). In turn, corner support members 173 and 174 emanate from corner support members 170 and 171, respectively. Apparatus 150 is shown in an upside-down orientation in FIG. 9A, in order to facilitate understanding of the conversion of apparatus 150 into a display configuration, as shown in FIG. 9B. Inner corner support members, such as inner corner support member 179, emanate from the ends of side wall members 152 and 153, in a manner similar to that described and shown with respect to the embodiment of FIGS. 1–6.

Lines of perforation 160–164 are provided in bottom wall 151 and side wall 152. In opposite side wall 153, perforation lines, oriented in substantially mirror fashion to perforation lines 161–164, are likewise provided. Subsequent to the erection and packing of apparatus 150, and its arrival at an ultimate destination, such as a vending establishment, the removable side wall portion 154, bounded by perforation lines 162–164, is removed. The similar removable wall side portion of opposite side wall 153 is likewise removed. Then, apparatus 150 may be grasped and with a snapping motion, bent upon itself as illustrated in FIG. 9B, so that bottom wall portions 151*a* and 151*b* are in substantially overlying parallel relationship to one another, in order to permit use of the converted container tray apparatus as a display apparatus. Perforation 160 is provided, so that when apparatus 150 is opened and folded as described, apparatus 150 may be maintained as two back-to-back display apparatus, as illustrated in FIG. 9B. Alternatively, the two display apparatus may be separated along perforation 160 to form two stand-alone displays.

FIGS. 10A and 10B illustrate an embodiment of the invention which is substantially similar to the embodiments of FIGS. 7 and 8, with the exception that no perforations are provided for facilitating opening and/or access to the article containment region. Apparatus 200 includes top wall portions 201, 202, end walls 203 and 204, and corner support members 206–213, with the interior corner support members having been omitted from FIG. 10A for simplicity of illustration. Corner support members 211 and 208 emanate from opposite edges of top wall member 201. In turn, corner support members 210 and 209 emanate from corner support members 211 and 208, respectively. Corner support members 212 and 207 emanate from opposite edges of top wall member 202. In turn, corner support members 213 and 206 emanate from corner support members 212 and 207, respectively.

FIG. 10B shows container apparatus 200, in a partially articulated configuration so as to clearly illustrate interior corner support members 216 and 217, which emanate from the end edges of side wall members 221 and 220, respectively, and have the substantially same structure and mode of operation as the interior corner support members 32, 33, 38 and 39 of the embodiment of FIGS. 1–6.

The present invention, in each of the several embodiments described herein, is believed to possess several advantages over prior art container tray apparatuses, including, as previously mentioned, substantially increased vertical stacking strength. Another advantage of the tray apparatus of the present invention is that the apparatus, as configured, with vertical corner support members wrapping around the outside of the side and/or end wall members, facilitates the articulation, erection, packing and sealing of such container tray apparatus, by automatic case erecting and sealing equipment, while having such improved strength characteristics.

The foregoing description and drawings merely explain and illustrate the invention, and the invention is not limited thereto, except insofar as the appended claims are so limited, as those skilled in the art who have the disclosure before them will be able to make modifications and variation therein without departing from the scope of the invention.

What is claimed is:

1. A container tray apparatus for the facilitated containment of articles, having at least one bottom wall member having at least a first side edge region and at least a first end edge region, at least a first side wall member operably connected to the at least first side edge region of the at least one bottom wall member, and at least a first end wall member operably connected to the at least first end edge region of the at least one bottom wall member, the at least first side wall member and the at least first end wall member being operably arrangeable with respect to one another so as to define at least a first corner region of the container tray apparatus, the at least first side wall member and the at least first end wall member further being operably arrangeable relative to the at least one bottom wall member, upon articulation, so as to further at least partially define an article containment region, the improvement in said container tray apparatus comprising:

at least one top wall member, operably positionable, upon said articulation, in substantially spaced, parallel, overlying relation to at least portion of the at least one bottom wall member, the at least one top wall member, when positioned in said substantially spaced, parallel, overlying relation to the at least a portion of the at least one bottom wall member, being substantially maintained in said overlying position over the at least first corner region by the at least first side wall member and the at least first end wall member; and corner support means, operably emanating at least in part from and articulable to said at least first top wall member, for providing vertical loading support for the container tray apparatus, toward providing resistance to undesired collapsing of said at least first corner region of the container tray apparatus upon the stacking of articles on top of the container tray apparatus, said corner support means including at least one corner support member operably emanating from the at least one top member, a first portion of said corner support member, upon articulation, being operably positionable in substantially parallel, at least partially overlying relation to the outer surface of the at least first side wall member, a second portion of said corner support member, upon articulation, being operably positionable in substantially parallel, at least partially overlying relation to the outer surface of the at least first end wall, and affixable thereto, for providing support for the at least first corner region, wherein each of the first and second portions of the at least one corner support member are operably configured for stabilized support of vertical loads exerted upon the container tray apparatus, upon stacking of further container tray apparatuses upon said container tray apparatus; and means for facilitating opening of the container tray apparatus to enable access to the article containment region, the means for facilitating opening of the container tray apparatus comprising at least one tearstrip member operably configured into the container tray apparatus, so as to enable the container tray apparatus to be opened, following articulation, loading and sealing of the container tray apparatus.

2. A container tray apparatus for the facilitated containment of articles, having at least one bottom wall member having at least a first side edge region and at least a first end edge region, at least a first side wall member operably connected to the at least first side edge region of the at least one bottom wall member, and at least a first end wall member operably connected to the at least first end edge region of the at least one bottom wall member, the at least first side wall member and the at least first end wall member being operably arrangeable with respect to one another so as to define at least a first corner region of the container tray apparatus, the at least first side wall member and the at least first end wall member further being operably arrangeable relative to the at least one bottom wall member, upon articulation, so as to further at least partially define an article containment region, the improvement in said container tray apparatus comprising:

at least one top wall member, operably positionable, upon said articulation, in substantially spaced, parallel, overlying relation to at least a portion of the at least one bottom wall member, the at least one top wall member, when positioned in said substantially spaced, parallel, overlying relation to the at least a portion of the at least one bottom wall member, being substantially maintained in said overlying position over the at least first corner region by the at least first side wall member and the at least first end wall member; and corner support means, operably emanating from and articulable to said at least first top wall member, for providing vertical loading support for the container tray apparatus, toward providing resistance to undesired collapsing of said at least first corner region of the container tray apparatus upon the stacking of articles on top of the container tray apparatus, said corner support means including at least one corner support member operably emanating from the at least one top member, a first portion of said corner support member, upon articulation, being operably positionable in substantially parallel, at least partially overlying relation to the outer surface of the at least first side wall member, a second portion of said corner support member, upon articulation, being operably positionable in substantially parallel, at least partially overlying relation to the outer surface of the at least first end wall member, and affixable thereto, for providing support for the at least first corner region, wherein each of the first and second portions of the at least one corner support member are operably configured for stabilized support of vertical loads exerted upon the container tray apparatus, upon stacking of further container tray apparatuses upon said container tray apparatus; and means for enabling conversion of the container tray apparatus into a containment and display apparatus, the means for enabling conversion of the container tray apparatus into a containment and display apparatus further comprising a first plurality of perforations disposed in the at least first side wall member, for enabling removal of a portion thereof; and at least a second perforation extending across the at least one bottom wall member, operably configured so that upon removal of said portion of the at least first side wall, said container apparatus may be folded along said second perforation to form at least two article folding and displaying regions.

* * * * *